US006017012A

United States Patent [19]

Henson, Jr.

[11] Patent Number: 6,017,012

[45] Date of Patent: Jan. 25, 2000

[54] CARD HOLDER

[76] Inventor: Melvin L. Henson, Jr., 766 Hedwick St., New Carlisle, Ohio 45344

[21] Appl. No.: 09/182,820

[22] Filed: Oct. 29, 1998

[51] Int. Cl.[7] ..... A47B 97/04

[52] U.S. Cl. ..... 248/460; 248/166

[58] Field of Search ..... 248/166, 168, 248/169, 170, 441.1, 447, 453, 460, 462, 464, 465.1, 167, 440, 469, 472, 473; 211/41.1, 45; 40/341; 84/327

[56] References Cited

U.S. PATENT DOCUMENTS

| | | | |
|---|---|---|---|
| D. 331,947 | 12/1992 | Blish et al. | D20/40 |
| 639,370 | 12/1899 | Gary | 248/462 |
| 730,713 | 6/1903 | Stafford | 248/491 |
| 1,648,243 | 11/1927 | Ramin | 248/464 |
| 1,887,591 | 11/1932 | Fugita | 40/681 |
| 2,317,867 | 4/1943 | Taylor et al. | 248/448 |
| 3,371,439 | 3/1968 | Smith et al. | 40/735 |
| 4,094,085 | 6/1978 | Nolan, Jr. | 40/735 |
| 4,326,687 | 4/1982 | Clyburn | 248/168 |
| 4,512,542 | 4/1985 | Black | 248/460 |
| 5,350,143 | 9/1994 | Hoshino | 248/166 |
| 5,361,521 | 11/1994 | Burtch | 40/750 |
| 5,451,026 | 9/1995 | Smith | 248/469 |
| 5,505,413 | 4/1996 | Hennessey | 248/166 |
| 5,713,547 | 2/1998 | Yu | 248/166 |

*Primary Examiner*—Leslie A. Braun
*Assistant Examiner*—Anita M. King

[57] ABSTRACT

A card holder for displaying a collectable trading card. The card holder includes a pair of elongate leg members where the upper ends of the leg members pivotally coupled together. A scissors brace is extended between the leg members. Each of the legs members has an outwardly extending arm member. The distal ends of the arm members each have an ledge extent outwardly extending from the respective arm member. The lower ends of the leg members each have a resting foot. Each of the ledge extents has an upwardly extending stop knob spaced apart from the associated arm member.

10 Claims, 2 Drawing Sheets

CARD HOLDER

BACKGROUND OF THE INVENTION

1. Field of the Invention

The present invention relates to card holders and more particularly pertains to a new card holder for displaying a collectable trading card.

2. Description of the Prior Art

The use of card holders is known in the prior art. More specifically, card holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,361,521; U.S. Pat. No. 5,451,026; U.S. Pat. No. Des. 331,947; U.S. Pat. No. 4,094,085; U.S. Pat. No. 3,371,439; and U.S. Pat. No. 1,887,591.

While these devices fulfill their respective, particular objectives and requirements, the aforementioned patents do not disclose a new card holder. The inventive device includes a pair of elongate leg members where the upper ends of the leg members pivotally coupled together. A scissors brace is extended between the leg members. Each of the legs members has an outwardly extending arm member. The distal ends of the arm members each have an ledge extent outwardly extending from the respective arm member. The lower ends of the leg members each have a resting foot. Each of the ledge extents has an upwardly extending stop knob spaced apart from the associated arm member.

In these respects, the card holder according to the present invention substantially departs from the conventional concepts and designs of the prior art, and in so doing provides an apparatus primarily developed for the purpose of displaying a collectable trading card.

SUMMARY OF THE INVENTION

In view of the foregoing disadvantages inherent in the known types of card holders now present in the prior art, the present invention provides a new card holder construction wherein the same can be utilized for displaying a collectable trading card.

The general purpose of the present invention, which will be described subsequently in greater detail, is to provide a new card holder apparatus and method which has many of the advantages of the card holders mentioned heretofore and many novel features that result in a new card holder which is not anticipated, rendered obvious, suggested, or even implied by any of the prior art card holders, either alone or in any combination thereof.

To attain this, the present invention generally comprises a pair of elongate leg members where the upper ends of the leg members pivotally coupled together. A scissors brace is extended between the leg members. Each of the legs members has an outwardly extending arm member. The distal ends of the arm members each have an ledge extent outwardly extending from the respective arm member. The lower ends of the leg members each have a resting foot. Each of the ledge extents has an upwardly extending stop knob spaced apart from the associated arm member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new card holder apparatus and method which has many of the advantages of the card holders mentioned heretofore and many novel features that result in a new card holder which is not anticipated, rendered obvious, suggested, or even implied by any of the prior art card holders, either alone or in any combination thereof.

It is another object of the present invention to provide a new card holder which may be easily and efficiently manufactured and marketed.

It is a further object of the present invention to provide a new card holder which is of a durable and reliable construction.

An even further object of the present invention is to provide a new card holder which is susceptible of a low cost of manufacture with regard to both materials and labor, and which accordingly is then susceptible of low prices of sale to the consuming public, thereby making such card holder economically available to the buying public.

Still yet another object of the present invention is to provide a new card holder which provides in the apparatuses and methods of the prior art some of the advantages thereof, while simultaneously overcoming some of the disadvantages normally associated therewith.

Still another object of the present invention is to provide a new card holder for displaying a collectable trading card.

Yet another object of the present invention is to provide a new card holder which includes a pair of elongate leg members where the upper ends of the leg members pivotally coupled together. A scissors brace is extended between the leg members. Each of the legs members has an outwardly extending arm member. The distal ends of the arm members each have an ledge extent outwardly extending from the respective arm member. The lower ends of the leg members each have a resting foot. Each of the ledge extents has an upwardly extending stop knob spaced apart from the associated arm member.

Still yet another object of the present invention is to provide a new card holder that provides a means to display a collectable trading card in a manner that does not damage the edges of the collectable trading card.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
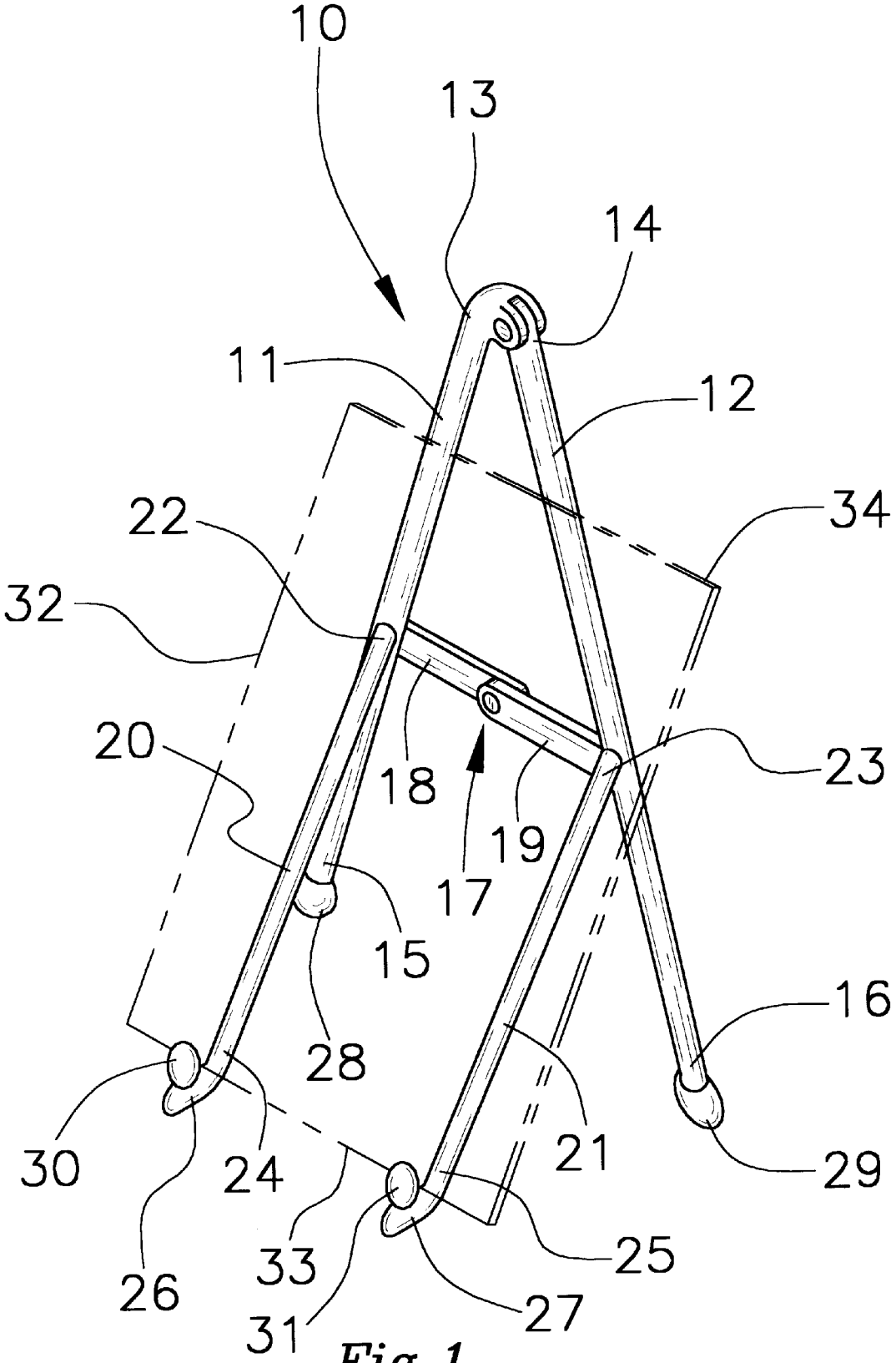
FIG. 1 is a schematic perspective view of a new card holder according to the present invention.

With reference now to the drawings, and in particular to FIGS. 1 through 4 thereof, a new card holder embodying the principles and concepts of the present invention and generally designated by the reference numeral 10 will be described.

As best illustrated in FIGS. 1 through 4, the card holder 10 generally comprises a pair of elongate leg members where the upper ends of the leg members pivotally coupled together. A scissors brace is extended between the leg members. Each of the legs members has an outwardly extending arm member. The distal ends of the arm members each have an ledge extent outwardly extending from the respective arm member. The lower ends of the leg members each have a resting foot. Each of the ledge extents has an upwardly extending stop knob spaced apart from the associated arm member.

Figure 3:
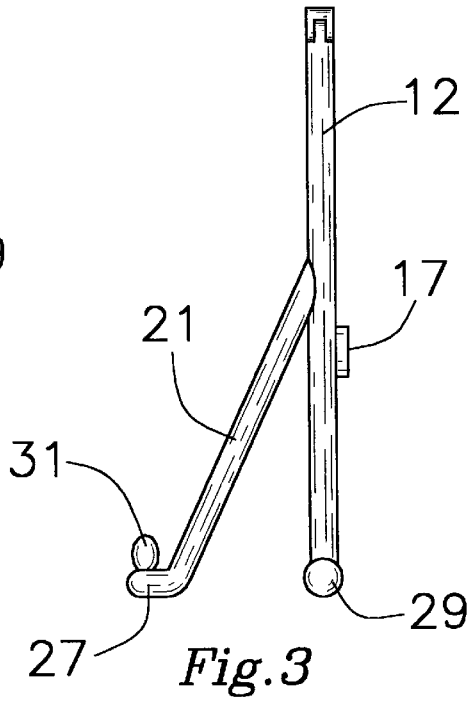
FIG. 3 is a schematic side view of the present invention.

In use, the card holder 10 comprises a pair of elongate leg members 11,12 each having opposite upper and lower ends 13,14,15,16, and a longitudinal axis extending between the upper and lower ends of the respective leg member. The upper ends 13,14 of the leg members are pivotally coupled together. With reference to FIG. 3, the longitudinal axes of the leg members generally lie in a common plane.

A scissors brace 17 is extended between the leg members. The scissors brace has a pair of elongate portions 18,19 pivotally coupled together. One of the elongate portions of the scissors brace is pivotally coupled to one of the leg members and the other of the elongate portions of the scissors brace is pivotally coupled to the other of the leg members. Preferably, each of the elongate portions of the scissors brace is pivotally coupled to the associated leg member at a pivot point on the associated leg member closer to the lower end of the associated leg member than to the upper end of the associated leg member. The pivot points are preferably generally equidistantly spaced apart from the lower ends of the associated leg members.

Figure 2:
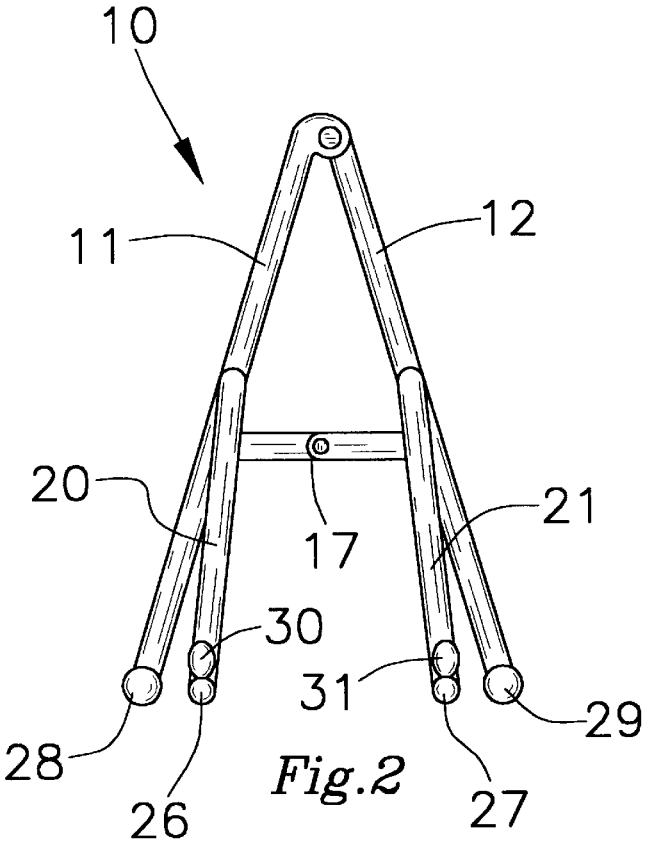
FIG. 2 is a schematic front side view of the present invention in the open position.
Figure 4:
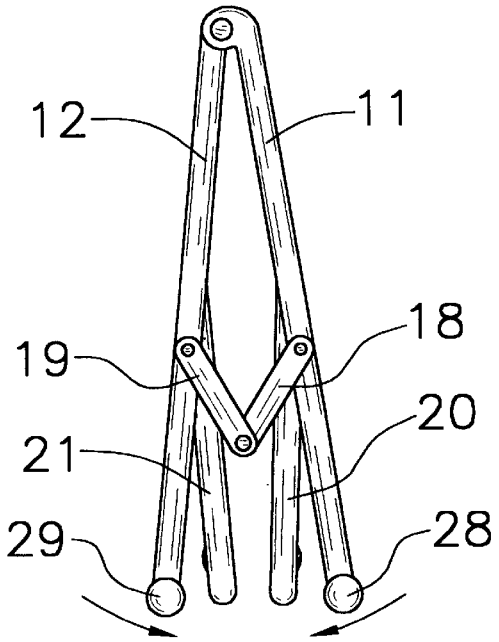
FIG. 4 is a schematic back side view of the present invention in the closed position.

In use, the leg members are pivotable between an open positioned as illustrated in FIG. 2 and a closed position as illustrated in FIG. 4. The longitudinal axes of the leg member defining a first acute angle in the open position and a second acute angle in the closed position. The first acute angle of the open position is greater than the second acute angle of the closed position. In an ideal illustrative embodiment, the first acute angle of the open position is about 35 degrees to provide sufficient stability during use supporting a collectable trading card and the second acute angle of the closed position is about 15 degrees to provide sufficient compactness for convenient storage.

Each of the legs members has an arm member 20,21 outwardly extending in a first direction from the common plane of the leg members. Each of the arm members has proximal and distal ends 22,23,24,25, and a longitudinal axis extending between the proximal and distal ends of the respective arm member. The proximal end 22,23 of each arm member is coupled to the associated leg member.

The leg members each have a length defined between the upper and lower ends of the respective leg member and the arm members each have a length defined between the proximal and distal ends of the respective arm member. Preferably, the length of each leg member is greater than the length of each arm member. Ideally, the length of each arm member is greater than about one-half the length of the associated leg member for providing optimal stability to the card holder in the open position.

As illustrated in FIG. 3, the longitudinal axis of each of the arm members is extended at an acute angle with respect to the longitudinal axis of the associated leg member. Preferably, the acute angle between each associated pair of leg and arm members is less than about 45 degrees. In the ideal illustrative embodiment, the acute angle between each associated pair of leg and arm members is about 30 degrees for providing optimal stability to the card holder in the open position. The longitudinal axes of the arm members generally lie in a common plane extending at an acute angle to the common plane of the leg members. As best illustrated in FIG. 2, the distal ends 24,25 of the arm members also lie in planes extending perpendicular to the common plane of the leg members located between planes substantially perpendicular to the common plane of the leg members in which the lower ends of the leg members lie.

The distal ends of the arm members each have an ledge extent 26,27 outwardly extending from the respective arm member at an obtuse angle to the longitudinal axis of the respective arm member. Preferably, the obtuse angle between each ledge extent and the longitudinal axis of the respective arm member is between about 110 degrees and about 135 degree. In the ideal illustrative embodiment, the obtuse angle between each ledge extent and the longitudinal axis of the respective arm member is about 120 degrees for providing optimal stability to the card holder in the open position. In use, the ledge extents of the arm members and the lower ends of the leg members are designed for resting on a resting surface such that the common plane of the longitudinal axes of the leg members is ideally extended generally perpendicular to the resting surface and the common plane of the longitudinal axes of the arm members is extended at an acute angle to the resting surface.

Preferably, the lower ends of the leg members each has a generally spherical resting foot 28,29 for engaging the resting surface. The resting feet preferably comprise resiliently deformable material for frictionally enhancing contact between the resting feet and the resting surface to help reduce sliding of the resting feet on the resting surface.

Each of the ledge extents has an upwardly extending generally oval-shaped stop knob 30,31. The stop knobs are spaced apart from the associated arm member to define a space therebetween designed for receiving a collectable trading card 32 therebetween so that the collectable trading card does not slide off of the ledge extents.

In use, the lower edge 33 of the trading card is rested on the ledge extents between the stop knobs and the leg members while the upper edge 34 of the trading card is rested on the leg members between the upper ends of the leg members and the proximal ends of the arm members. This allows the collectable trading card to be displayed in a stable manner without damaging the edges of the trading card.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A card holder for holding a generally rectangular trading card, said card holder comprising:

a pair of elongate leg members each having opposite upper and lower ends, and a longitudinal axis extending between said upper and lower ends of the respective leg member;

said upper ends of said leg members being pivotally coupled together;

a scissors brace being extended between said leg members;

each of said legs members having an outwardly extending arm member;

each of said arm members having proximal and distal ends, and a longitudinal axis extending between said proximal and distal ends of the respective arm member;

said proximal end of said arm members being coupled to the associated leg member;

said distal ends of said arm members each having an ledge extent outwardly extending from the respective arm member at an obtuse angle to the longitudinal axis of the respective arm member;

said ledge extents of said arm members and said lower ends of said leg members being for resting on a resting surface;

said lower ends of said leg members each having a resting foot for engaging the resting surface; and each of said ledge extents having an upwardly extending stop knob, said stop knobs being spaced apart from the associated arm member.

2. The card holder of claim 1, wherein said scissors brace has a pair of elongate portions pivotally coupled together, one of said elongate portions of said scissors brace being pivotally coupled to one of said leg members, the other of said elongate portions of said scissors brace being pivotally coupled to the other of said leg members.

3. The card holder of claim 2, wherein each of said elongate portions of said scissors brace is pivotally coupled to the associated leg member at a pivot point on the associated leg member closer to the lower end of the associated leg member than to the upper end of the associated leg member, and wherein said pivot points are generally equidistantly spaced apart from the lower ends of the associated leg members.

4. The card holder of claim 1, wherein said leg members are pivotable between an open positioned and a closed position, wherein said longitudinal axes of said leg member define a first acute angle in said open position and a second acute angle in said closed position, said first acute angle of said open position being greater than said second acute angle of said closed position.

5. The card holder of claim 4, wherein said first acute angle of said open position is about 35 degrees and said second acute angle of said closed position is about 15 degrees.

6. The card holder of claim 1, wherein said longitudinal axis of each of said arm members are extended at an acute angle with respect to the longitudinal axis of the associated leg member.

7. The card holder of claim 6, wherein said acute angle between each associated pair of leg and arm members is less than about 45 degrees.

8. The card holder of claim 6, wherein said acute angle between each associated pair of leg and arm members is about 30 degrees.

9. The card holder of claim 1, wherein said resting feet comprise resiliently deformable material for frictionally enhancing contact between said resting feet and the resting surface to help reduce sliding of the resting feet on the resting surface.

10. A card holder for holding a generally rectangular trading card, said card holder comprising:

a pair of elongate leg members each having opposite upper and lower ends, and a longitudinal axis extending between said upper and lower ends of the respective leg member;

said upper ends of said leg members being pivotally coupled together;

a scissors brace being extended between said leg members, said scissors brace having a pair of elongate portions pivotally coupled together, one of said elongate portions of said scissors brace being pivotally coupled to one of said leg members, the other of said elongate portions of said scissors brace being pivotally coupled to the other of said leg members;

wherein each of said elongate portions of said scissors brace is pivotally coupled to the associated leg member at a pivot point on the associated leg member closer to the lower end of the associated leg member than to the upper end of the associated leg member;

said pivot points being generally equidistantly spaced apart from the lower ends of the associated leg members;

said leg members being pivotable between an open positioned and a closed position;

said longitudinal axes of said leg member defining a first acute angle in said open position and a second acute angle in said closed position, said first acute angle of said open position being greater than said second acute angle of said closed position, wherein said first acute angle of said open position is about 35 degrees and said second acute angle of said closed position is about 15 degrees;

said longitudinal axes of said leg members generally lying in a common plane;

each of said legs members having an arm member outwardly extending in a first direction from said common plane of said leg members;

each of said arm members having proximal and distal ends, and a longitudinal axis extending between said proximal and distal ends of the respective arm member;

said proximal end of said arm members being coupled to the associated leg member;

said longitudinal axis of each of said arm members being extended at an acute angle with respect to the longitudinal axis of the associated leg member;

wherein said acute angle between each associated pair of leg and arm members is about 30 degrees;

said longitudinal axes of said arm members generally lying in a common plane extending at an acute angle to said common plane of said leg members;

said distal ends of said arm members each having an ledge extent outwardly extending from the respective arm member at an obtuse angle to the longitudinal axis of the respective arm member;

wherein said obtuse angle between each ledge extent and the longitudinal axis of the respective arm member is about 120 degrees;

said ledge extents of said arm members and said lower ends of said leg members being for resting on a resting surface such that the common plane of said longitudinal axes of said leg members is extended generally perpendicular to the resting surface and said common plane of said longitudinal axes of said arm members is extended at an acute angle to the resting surface;

said lower ends of said leg members each having a generally spherical resting foot for engaging the resting surface;

said resting feet comprising resiliently deformable material for frictionally enhancing contact between said resting feet and the resting surface to help reduce sliding of the resting feet on the resting surface;

each of said ledge extents having an upwardly extending generally oval-shaped stop knob, said stop knobs being spaced apart from the associated arm member to define a space therebetween adapted for receiving a trading card therebetween; and a generally rectangular trading card having upper and lower edges, said lower edge of said trading card being rested on said ledge extents between said stop knobs and said leg members, said upper edge of said trading card being rested on said leg members between said upper ends of said leg members and said proximal ends of said arm members.

* * * * *